US010087728B2

(12) United States Patent
Chalifoux

(10) Patent No.: US 10,087,728 B2
(45) Date of Patent: Oct. 2, 2018

(54) METHOD AND APPARATUS FOR INSTALLING AND REMOVING AN ELECTRIC SUBMERSIBLE PUMP

(71) Applicant: Petrospec Engineering Ltd., Sherwood Park (CA)

(72) Inventor: Gerald V. Chalifoux, Sherwood Park (CA)

(73) Assignee: Petrospec Engineering Inc., Sherwood Park (CA)

( * ) Notice: Subject to any disclaimer, the term of this patent is extended or adjusted under 35 U.S.C. 154(b) by 674 days.

(21) Appl. No.: 14/576,957

(22) Filed: Dec. 19, 2014

(65) Prior Publication Data

US 2015/0101791 A1 Apr. 16, 2015

Related U.S. Application Data

(63) Continuation-in-part of application No. 12/877,940, filed on Sep. 8, 2010, now Pat. No. 8,915,303.

(30) Foreign Application Priority Data

Jun. 22, 2010 (CA) ..... 2707059

(51) Int. Cl.

| | |
|---|---|
| ***E21B 23/03*** | (2006.01) |
| ***E21B 43/12*** | (2006.01) |
| ***E21B 33/068*** | (2006.01) |
| ***E21B 23/02*** | (2006.01) |
| ***E21B 19/22*** | (2006.01) |

(52) U.S. Cl.

CPC ..... *E21B 43/128* (2013.01); *E21B 19/22* (2013.01); *E21B 23/02* (2013.01); *E21B 33/068* (2013.01)

(58) Field of Classification Search

CPC ..... E21B 43/128; E21B 19/22; E21B 23/02; E21B 33/068; E21B 34/14

USPC ..... 166/381, 377, 77.2, 85.1, 85.4, 380, 386

See application file for complete search history.

(56) References Cited

U.S. PATENT DOCUMENTS

| | | | |
|---|---|---|---|
| 4,498,537 | A | 2/1985 | Cook |
| 5,146,982 | A | 9/1992 | Dinkins |
| 5,269,377 | A | 12/1993 | Martin |
| 5,348,094 | A | 9/1994 | Cholet |
| 5,375,656 | A | 12/1994 | Wilson |
| 5,544,706 | A | 8/1996 | Reed |
| 6,017,198 | A | 1/2000 | Traylor |

(Continued)

FOREIGN PATENT DOCUMENTS

| | | | |
|---|---|---|---|
| GB | 2 359 317 | A | 8/2001 |

*Primary Examiner* — Taras P Bemko

(74) *Attorney, Agent, or Firm* — Christensen O'Connor Johnson Kindness, PLLC

(57) ABSTRACT

In combination, an inverted electric submersible pump (ESP) sized to fit within a downhole production path and a coiled tubing string. The coiled tubing string has an internal bore, and one or more supply lines housed within the internal bore and connected between surface and the inverted ESP. The inverted ESP has a pump section and a motor section, the motor section disposed above the pump section, and the pump section having one or more inlet ports and one or more outlet ports. At least one sealing element is positioned between the one or more inlet ports and the one or more outlet ports and is sized to seal against the downhole production path. A coiled tubing connection sealably connects the motor section to the coiled tubing string.

20 Claims, 4 Drawing Sheets

(56) References Cited

U.S. PATENT DOCUMENTS

| | | | | |
|---|---|---|---|---|
| 6,257,334 | B1 | 7/2001 | Cyr | |
| 6,328,111 | B1 | 12/2001 | Bearden | |
| 6,557,642 | B2 | 5/2003 | Head | |
| 6,644,400 | B2 | 11/2003 | Irwin, Jr. | |
| 6,662,872 | B2 | 12/2003 | Gutek | |
| 6,857,486 | B2 | 2/2005 | Chitwood | |
| 7,299,879 | B2 | 11/2007 | Irwin, Jr. | |
| 2004/0188096 | A1 | 9/2004 | Traylor | |
| 2004/0211569 | A1 | 10/2004 | Vinegar | |
| 2006/0060357 | A1 | 3/2006 | Kelly | |
| 2008/0078560 | A1 | 4/2008 | Hall | |
| 2010/0212914 | A1* | 8/2010 | Traylor ..... | E21B 23/08 166/377 |
| 2011/0300008 | A1 | 12/2011 | Fielder | |

* cited by examiner

METHOD AND APPARATUS FOR INSTALLING AND REMOVING AN ELECTRIC SUBMERSIBLE PUMP

FIELD

This relates to a method of installing or removing an electric submersible pump in a well with a positive well head pressure.

BACKGROUND

In wells with a positive well head pressure, such as SAGD (steam assisted gravity drainage) wells, the well must be depressurized, generally by cooling the well, in order to install or remove the electric submersible pump. The process to cool the well and reheat the well afterward adds a number of days onto the servicing of the well.

SUMMARY

According to an aspect, there is provided a method of servicing an electric submersible pump in a well with a positive well head pressure. The well comprises a casing and a wellhead mounted to the casing. The wellhead has a sealable injection port and at least one production port. The method comprises the steps of providing production tubing in the casing connected to the wellhead such that production fluids flow through the production tubing and out the at least one production port of the wellhead; a coil tubing string having an electric submersible pump at a downhole end of the coil tubing string and control lines through the coil tubing string for controlling the electric submersible pump; and a pump-receiving housing above the injection port of the wellhead, the pump-receiving housing being sealed to atmosphere when the injection port is open, and openable to atmosphere when the injection port is sealed. The injection port is sealed and the pump-receiving housing is opened to insert or remove the electric submersible pump from the pump-receiving housing. The pump-receiving housing is closed and the injection port is opened to move the electric submersible pump to or from the production tubing in the well. The electric submersible pump may be an inverted electric submersible pump whereby the motor and customized components to attach the motor to the coiled tubing is at the top of the assembly, and the pump is at the bottom of the assembly. The control lines may comprise an oil feed line for continuously providing the electric submersible pump with clean oil and to maintain a positive pressure relative to the well pressure at the electric submersible pump location.

According to another aspect, there is provided a method of removing an electric submersible pump from the well. The method comprises the steps of providing production tubing in the casing connected to the wellhead such that production fluids flow through the production tubing and out the at least one production port of the wellhead; a coil tubing string positioned through the injection port and the production tubing, the coil tubing string having an electric submersible pump at a downhole end of the coil tubing string and control lines through the coil tubing string for controlling the electric submersible pump, the electric submersible pump being sized to pass through the production tubing; and a pump-receiving housing above the injection port of the wellhead, the pump-receiving housing being sealed to atmosphere when the injection port is open, and openable to atmosphere when the injection port is sealed. The coil tubing is retracted from the well such that the electric submersible pump is withdrawn through the injection port and into the pump-receiving housing. The injection port is sealed and the pump-receiving housing is opened to atmosphere. The electric submersible pump is removed from the pump-receiving housing.

According to another aspect, there is provided a method of inserting an electric submersible pump in the well. The method comprising the steps of providing production tubing in the casing connected to the wellhead such that production fluids flow through the production tubing and out the a least one production port of the wellhead; a coil tubing string having an electric submersible pump at a downhole end of the coil tubing string and control lines through the coil tubing string for controlling the electric submersible pump, the electric submersible pump being sized to pass through the production tubing; and a pump-receiving housing above the injection port of the wellhead, the pump-receiving housing being sealed to atmosphere when the injection port is open, and openable to atmosphere when the injection port is sealed. With the injection port sealed, the electric submersible pump is positioned in the pump-receiving housing. The pump-receiving housing is sealed to atmosphere, and the injection port is opened. The coil tubing and the electric submersible pump is lowered into the production tubing in the well with a positive well head pressure through the injection port of the wellhead and is seated into a pressure sealing seat located at the downhole end of the tubing.

According to another aspect, there is provided, in combination, a coil tubing string and an inverted electric submersible pump (ESP). The coil tubing string comprises an internal bore and control lines housed within the internal bore. The control lines extend from the surface end to the pump connection end. An oil supply supplies oil to the inverted ESP through at least one control line at a pressure greater than the pressure of a wellbore. The inverted ESP is sized to fit within production tubing and comprises a pump section and a motor section. The motor section is disposed above the pump section. The pump section comprises at least one inlet port and at least one outlet port. A coil tubing connection sealably connects the motor section to the coil tubing string. A seat engagement seal is provided on the pump section between the at least one inlet port and the at least one outlet port. The seat engagement seal engages a downhole end of the production tubing, such that the inlet ports are in communication with wellbore fluids, and the outlet ports are in communication with an interior of the production tubing.

According to another aspect, there is provided, in combination, an inverted electric submersible pump (ESP) sized to fit within a downhole production path and a coiled tubing string. The coiled tubing string comprises an internal bore, and one or more supply lines housed within the internal bore and connected between surface and the inverted ESP. The inverted ESP comprises a pump section and a motor section, the motor section disposed above the pump section, the pump section comprising one or more inlet ports and one or more outlet ports; at least one sealing element positioned between the one or more inlet ports and the one or more outlet ports that is sized to seal against the downhole production path; and a coiled tubing connection for sealably connecting the motor section to the coiled tubing string.

According to another aspect, the inverted ESP may comprise one or more of the following features: the one or more supply lines may comprise an oil delivery line connected between a supply of oil on surface and the inverted ESP; the one or more supply lines may comprises one or more transmission lines, each transmission line comprising an electric power line or a temperature and pressure data acquisition and transmission line, and wherein the oil delivery line is a metal capillary tube and provides structural support to the one or more transmission lines; the inverted ESP may comprise a thrust chamber between the pump section and the motor section, and the oil may be supplied by the oil delivery line passes through the motor section and the thrust chamber prior to being ejected from the inverted ESP; the oil may be ejected into the interior of the production path; the oil may be ejected from the inverted ESP from a check valve; the oil may be supplied to the oil delivery line by a positive displacement pump; the at least one pump sealing ring may be mounted to an exterior surface of the thrust chamber; the at least one pump sealing ring and the pump seating nipple may be made from metal and the at least one pump sealing ring engages the pump seating nipple in an interference fit engagement; the pump sealing ring and the pump seating nipple may be sized such that interference fit engagement causes the at least one pump sealing ring to elastically deform; the pump sealing ring and the pump seating nipple may be passive sealing elements; and the one or more inlet ports may be directly open to a hydrocarbon formation.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A method of servicing an electric submersible pump in a well with a positive well head pressure will now be described with reference to FIGS. 1-4.

Figure 1:
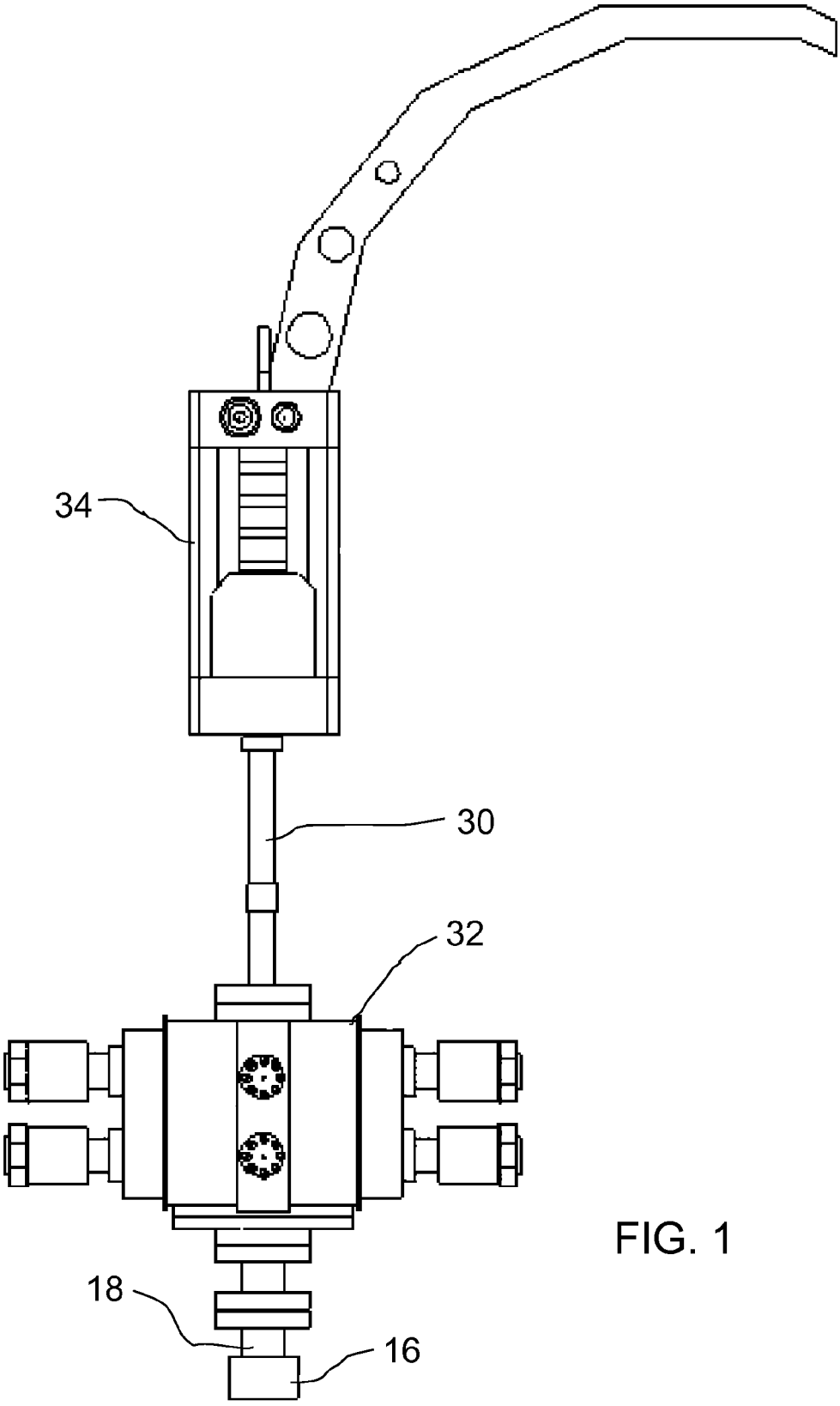
FIG. 1 is a side elevation view of the apparatus for servicing an electric submersible pump.
Figure 2:
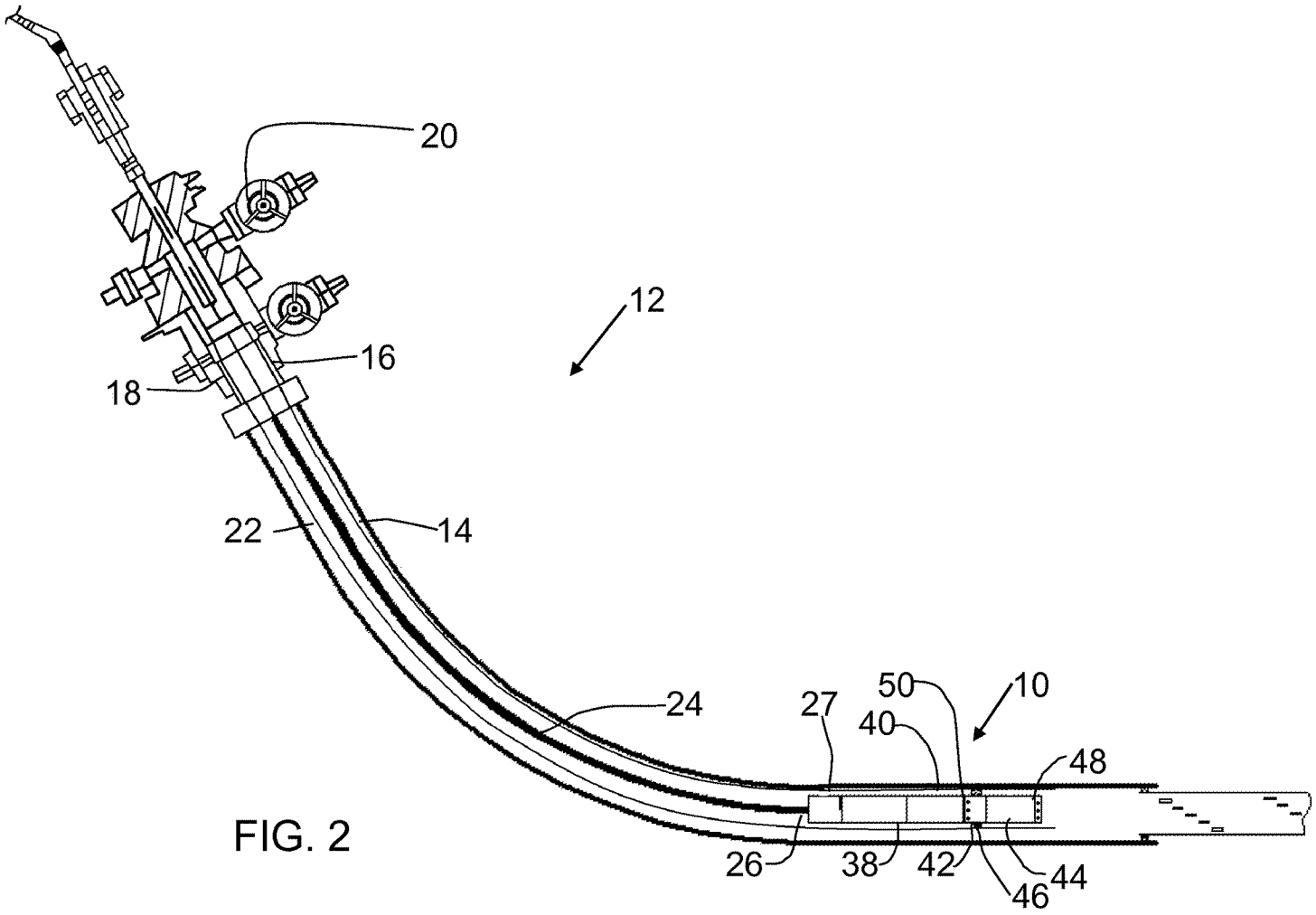
FIG. 2 is a side elevation view of the well completion with the electric submersible pump.

The method described below may be used to install or remove an electric submersible pump 10 without having to cool or depressurize the well. This method may be particularly useful for thermal stimulated wells such as SAGD wells or other wells with a positive well head pressure, or other wells with a positive well head pressure that are required to be pressure relieved prior to being opened. Referring to FIG. 2, pressurized well 12 includes a casing 14 and a wellhead 16 mounted to casing 14. Wellhead 16 has a sealable injection port 18, and production ports 20. Referring to FIG. 1, injection port 18 may be sealed by a BOP 32 (blowout preventer) as shown, or it may also be sealed by a valve, a plug, etc., which may be above or below the actual port 18. Referring again to FIG. 2, the number of production ports 20 may vary depending upon the design of wellhead 16. Production tubing 22 is positioned in casing 14 and is connected to wellhead 16. Production fluids that are pumped upward by electric submersible pump 10 flow through production tubing 22 and out production ports 20 of wellhead 16. Electric submersible pump 10 is carried by a coil tubing string 24 at a downhole end 26 of coil tubing string 24, and is sized such that it is able to be run through production tubing 22. Supply lines 28, which may be instrumentation lines, control lines, or electrical or fluid delivery lines, are preferably all run through and enclosed within coil tubing string 24 and connect to electric submersible pump 10. Supply lines 28 may include transmission lines such as power and communication lines for providing control signals, and oil feed lines that continuously provide clean oil to the electric submersible pump 10 and maintain a positive pressure relative to the well pressure at the ESP location. Preferably, fluids provided through supply lines 28 will be fed using positive displacement pumps at ground surface. Also preferably, electric submersible pump 10 is designed such that clean oil is constantly pumped through from surface, which prevents any unnecessary wear from dirty oil, and also helps create a positive seal against downhole contaminants. This may be done through a capillary tube, such as a metal capillary tube that can provide structural support to other supply lines 28, such as power or signal lines. A pump-receiving housing 30, shown in FIG. 1, is located above injection port 18 of wellhead 16. The height of pump receiving housing 30 will depend upon the size of electric submersible pump 10. Pump-receiving housing 30 is designed such that is may be sealed to the atmosphere when injection port 18 is open, and openable to the atmosphere when injection port 18 is sealed. In other words, housing 30 works with injection port 18 to ensure that well 12 is always sealed when it is pressurized. Referring to FIG. 1, a blowout preventer 32 is located above wellhead 16 and below pump-receiving housing 30. Coil tubing injector 34 is located above pump-receiving housing 30 and, referring to FIG. 2, is used to control the position of coil tubing string 24 and electric submersible pump 10 in well 12.

With the elements described above, electric submersible pump 10 may be installed or removed without having to cool well 12. In order to insert electric submersible pump 10 into a well with a positive well head pressure, injection port 18 is first sealed by closing BOP 32 and pump-receiving housing 30 is opened. Electric submersible pump 10 is connected to coil tubing string 24 and inserted into housing 30. Pump-receiving housing 30 is then closed and sealed to atmosphere and BOP 32 is opened to allow electric submersible pump 10 to be inserted through injection port 18 in wellhead 16 and into well 12 by operating coil tubing injector 34. In order to remove electric submersible pump 10 from pressurized well 10, the process is reversed, with coil tubing injector 34 lifting electric submersible pump 10 through wellhead 16 and into housing 30. BOP 32 is then closed and sealed, and housing 30 is opened to provide access to electric submersible pump 10. Electric submersible pump 10 may then be serviced or replaced, as necessary.

As depicted, electric submersible pump 10 is preferably an inverted electric submersible pump, and is run off a 1¼"-3½" coil tubing string 24 that contains the instrumentation lines. Other sizes may also be used, depending on the preferences of the user and the requirements of the well. When compared with traditional electric submersible pumps, electric submersible pump 10 lacks the seal section, motor pothead and wellhead feedthrough. As shown, electric submersible pump 10 includes a power head 27, motor section 38, thrust chamber 40, electric submersible pressure sealing seat 42 and electric submersible pump section 44. Thrust chamber 40 includes two mechanical seals with a check valve (not shown), and replaces the conventional seal/protector section that separates pump section 44 and motor section 38. The check valve in thrust chamber 40 allows the lubricating fluid supplied by supply line 28 to exit thrust chamber 40 and commingle with, for example, produced fluids from the well with the pump discharge from outlet ports 50. Pressure sealing seat 42, commonly referred to in industry as a pump seating nipple, has a seal 46 between inlet ports 48 and outlet ports 50. Inlet ports 48 are in communication with downhole fluids to be pumped to surface via outlet ports 50, which are positioned within production tubing 22.

Figure 4:
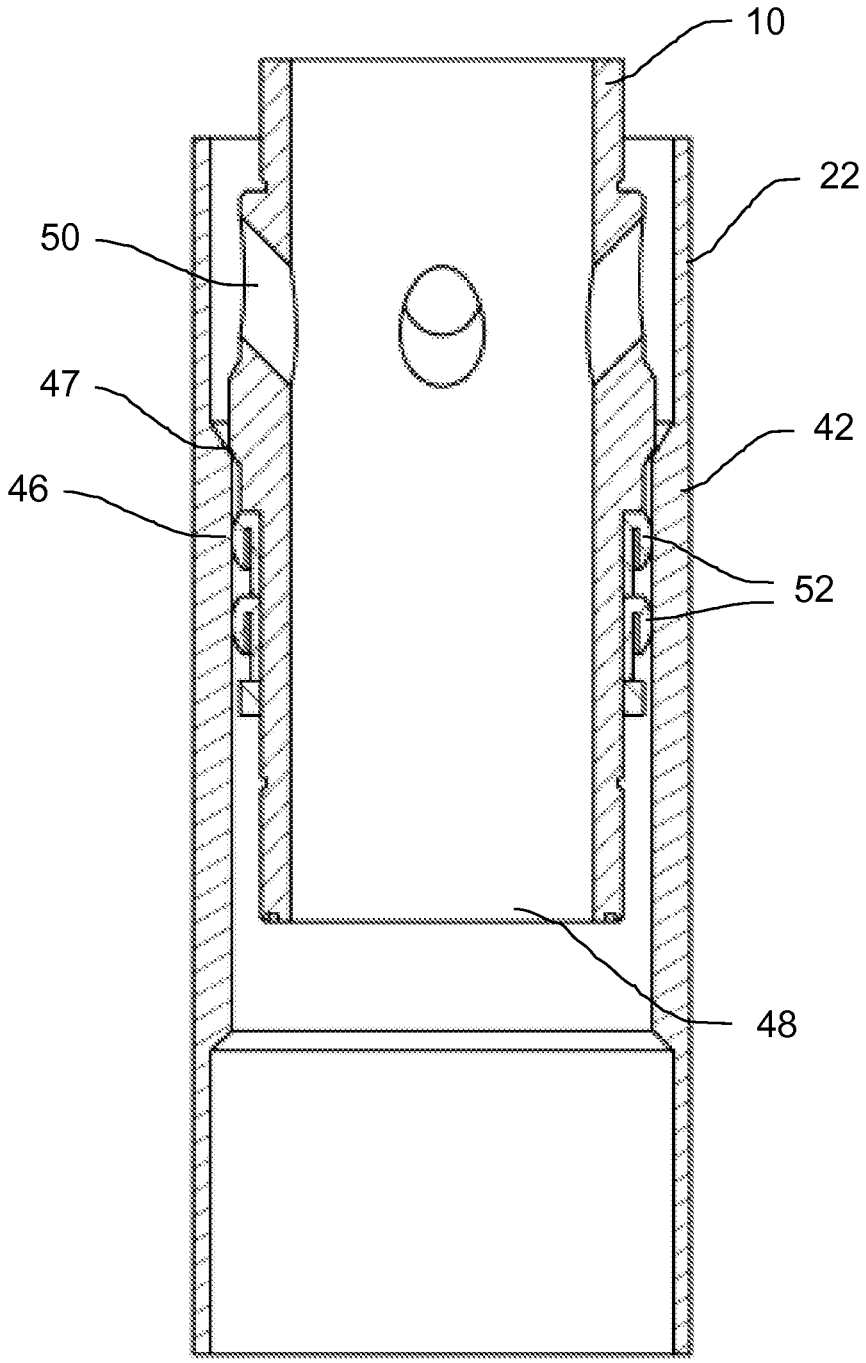
FIG. 4 is a detailed side elevation view in section of a pump seating nipple and pump sealing rings.

Referring to FIG. 4, a detailed view of an example of an engagement between pump seating nipple 42 and electric submersible pump 10 is shown. Pump seating nipple 42 is shown as being located on an inner surface toward the end of production tubing 22, and seal 46 is provided by pump sealing rings 52 carried by electric submersible pump 10 that engage pump seating nipple 42 in an interference fit and engagement shoulders 47. Pump seating nipple 42 and pump sealing rings 52 are preferably made from metal or other hard surfaces that are manufactured to provide an interference seal between pump seating nipple 42 when installed. As shown, pump seating nipple 42 defines a tapered seal seat that engages sealing rings 52 as electric submersible pump 10 is lowered toward the bottom of production tubing 22. Sealing rings 52 are preferably designs such that they are compressible to provide the interference fit with pump seating nipple 42. Sealing rings 52 preferably deform elastically to a small degree to ensure a proper engagement. It will be understood that the number of pump sealing rings 52 and their actual dimensions may vary depending on the preferences of the user, the materials used, and the circumstances under which electric submersible pump will be used. In some embodiments, pump sealing rings 52 may be manufactured into the body of thrust chamber 40, which may be installed at the factory when electric submersible pump 10 is manufactured. Pump sealing rings 52 may also be manufactured as a separate component that is connected between thrust chamber 40 and pump section 44.

As depicted in FIG. 4, the top-most pump seal ring 52 is positioned immediately below outlet ports 50 to minimize the amount of debris that may accumulate between the seal and outlet ports 50. If a seal were provided closer to inlet ports 48, there would be a greater amount of space in which debris could accumulate, which would make it more difficult to disengaged and remove electric submersible pump 10 for servicing.

Preferably, electric submersible pump 10 is installed using the passive seal provided by pump seating nipple 42 and pump sealing rings 52 as depicted such that a packer, such as a sealbore packer, or other active sealing element is not required. As a result of this design, it is preferred that the full weight of the submersible pump 10 will not be borne by pump seating nipple 42, but that most or substantially all of the weight of electric submersible pump 10 will be supported by coiled tubing string 24. During installation, electric submersible pump 10 will be lowered until it engages pump seating nipple 42. The operator will be notified of this as a certain depth is reached and by monitoring the weight supported by coiled tubing injector 34. Once sufficient weight has been applied to cause pump sealing rings 52 and pump seating nipple 42 to properly seal electric submersible pump 10, the remaining weight will continue to be supported along coiled tubing string 24. After properly engaged, and depending on the specifications of the various components, coiled tubing injector 34 may be backed off to support additional weight, while still allowing sufficient weight to maintain the seal between pump seating nipple 42 and pump sealing rings 52.

Figure 3:
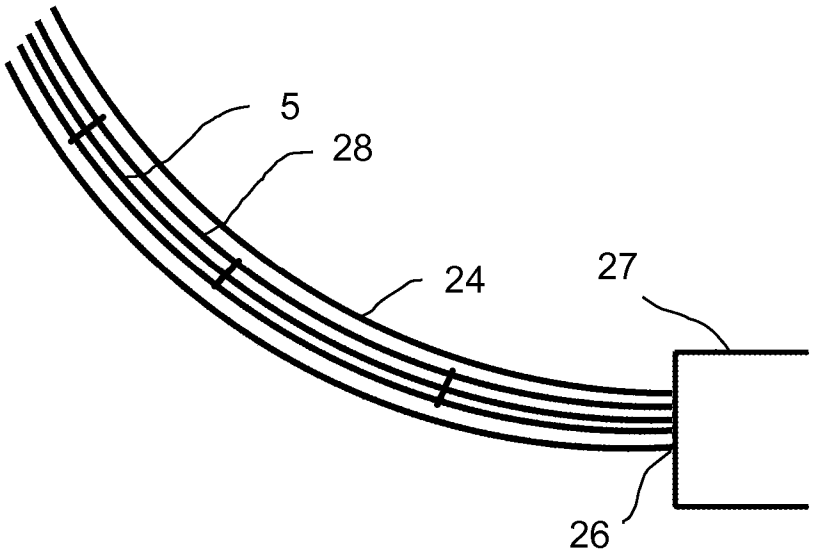
FIG. 3 is a detailed side elevation view in section of the coiled tubing string.

Referring to FIGS. 2 and 3, the motor oil delivery system comprises of a surface mounted pumping and control unit that maintains a very constant flow of oil through the stainless steel capillary tubing 5 of FIG. 3 and into the motor section 38 and thrust chamber 40 of FIG. 2 regardless of the pump discharge pressure. In this way, the internal pressure of the capillary tubing 5 of FIG. 3 and the motor section 38 and thrust chamber 40 of FIG. 2 is maintained at a pressure that is 10 psi to 50 psi higher than the bottom hole pressure at the pump discharge. This will ensure that no bottom hole fluids shall enter and contaminate the motor section 38 or thrust chamber 40.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. In combination, an inverted electric submersible pump (ESP) sized to fit within a downhole production path, a coiled tubing string, and a downhole seat engagement seal carried by the downhole production path, wherein:

the coiled tubing string comprises:

an internal bore;

an oil delivery line housed within the internal bore connected to a supply of oil on surface and to the inverted ESP at a pressure greater than the pressure of a wellbore; and one or more transmission lines, each transmission line comprising an electric power line or a temperature and pressure data acquisition and transmission line, wherein the oil delivery line is a metal capillary tube and provides structural support to the one or more transmission lines;

the inverted ESP comprises:

a pump section and a motor section, the motor section being disposed above the pump section, the pump section comprising one or more inlet ports and one or more outlet ports; at least one pump sealing ring positioned between the one or more inlet ports and the one or more outlet ports; and a coiled tubing connection for sealably connecting the motor section to the coiled tubing string; and the downhole seat engagement seal comprises a pump seating nipple that engages and seals directly against the at least one pump sealing ring on the pump section such that the one or more inlet ports are directly open to a hydrocarbon formation, and the one or more outlet ports are in communication with an interior of the production path.

2. The combination of claim 1, wherein the inverted ESP comprises a thrust chamber between the pump section and the motor section, and wherein oil supplied by the oil delivery line passes through the motor section and the thrust chamber prior to being ejected from the inverted ESP.

3. The combination of claim 2, wherein the oil is ejected into the interior of the production path.

4. The combination of claim 2, wherein the oil is ejected from the inverted ESP from a check valve.

5. The combination of claim 2, wherein the oil is supplied to the oil delivery line by a positive displacement pump.

6. The combination of claim 2, wherein the at least one pump sealing ring is mounted to an exterior surface of the thrust chamber.

7. The combination of claim 1, wherein the at least one pump sealing ring and the pump seating nipple are made from metal and the at least one pump sealing ring engages the pump seating nipple in an interference fit engagement.

8. The combination of claim 7, wherein the pump sealing ring and the pump seating nipple are sized such that interference fit engagement causes the at least one pump sealing ring to elastically deform.

9. The combination of claim 1, wherein the pump sealing ring and the pump seating nipple are passive sealing elements.

10. In combination, an inverted electric submersible pump (ESP) sized to fit within a downhole production tubing string, a coiled tubing string, and a downhole seat engagement seal, wherein:

the coiled tubing string comprises:

an internal bore; and one or more supply lines housed within the internal bore connected from a supply of oil on surface to the inverted ESP;

the inverted ESP comprises:

a pump section and a motor section, the motor section being disposed above the pump section, the pump section comprising one or more inlet ports and one or more outlet ports;

at least one pump sealing ring positioned between the one or more inlet ports and the one or more outlet ports; and a coiled tubing connection for sealably connecting the motor section to the coiled tubing string; and the downhole seat engagement seal comprises a pump seating nipple that engages and seals directly against the at least one pump sealing ring on the pump section such that the one or more inlet ports are directly open to a hydrocarbon formation, and the one or more outlet ports are in communication with an interior of the production tubing string, the pump seating nipple comprising a shoulder that extends inward from an inner surface of the production tubing string and that is directly supported by the production tubing string such that the shoulder of the pump seating nipple transfers at least a portion of the weight of the inverted ESP to the production tubing string;

wherein the one or more supply lines comprises an oil delivery line connected between the supply of oil on surface and the inverted ESP, and further wherein the one or more supply lines further comprises one or more transmission lines, each transmission line comprising an electric power line or a temperature and pressure data acquisition and transmission line, and wherein the oil delivery line is a metal capillary tube and provides structural support to the one or more transmission lines.

11. The combination of claim 10, wherein the inverted ESP comprises a thrust chamber between the pump section and the motor section.

12. The combination of claim 11, wherein the at least one pump sealing ring is mounted to an exterior surface of the thrust chamber.

13. The combination of claim 10, wherein the at least one pump sealing ring and the pump seating nipple are made from metal and the at least one pump sealing ring engages the pump seating nipple in an interference fit engagement.

14. The combination of claim 13, wherein the pump sealing ring and the pump seating nipple are sized such that interference fit engagement causes the at least one pump sealing ring to elastically deform.

15. The combination of claim 10, wherein the pump sealing ring and the pump seating nipple are passive sealing elements.

16. In combination, an inverted electric submersible pump (ESP) sized to fit within a downhole production path and a coiled tubing string, wherein:

the coiled tubing string comprises:

an internal bore;

an oil delivery line housed within the internal bore connected to a supply of oil on surface and to the inverted ESP at a pressure greater than the pressure of a wellbore; and at least one of an electric power line and a temperature and pressure data acquisition and transmission line, wherein the oil delivery line is a metal capillary tube and provides structural support to the at least one of an electric power line and a temperature and pressure data acquisition and transmission line; and the inverted ESP comprises:

a pump section and a motor section, the motor section being disposed above the pump section, the pump section comprising one or more inlet ports and one or more outlet ports;

at least one sealing element positioned between the one or more inlet ports and the one or more outlet ports that is sized to seal against the downhole production path; and a coiled tubing connection for sealably connecting the motor section to the coiled tubing string.

17. The combination of claim 16, wherein oil is ejected from the inverted ESP into the interior of the production path.

18. The combination of claim 16, wherein oil is ejected from the inverted ESP from a check valve.

19. The combination of claim 16, wherein oil is supplied to the oil delivery line by a positive displacement pump.

20. The combination of claim 16, further comprising a pump seating nipple that engages and seals directly against the at least one pump sealing ring on the pump section such that the one or more inlet ports are directly open to a hydrocarbon formation.

* * * * *